US005167437A

United States Patent [19]

Merten et al.

[11] Patent Number: 5,167,437

[45] Date of Patent: Dec. 1, 1992

[54] MECHANISMS FOR DRAWING A CHAIN INTO OR THROUGH A CHANNEL OF A CHAIN GUIDE

[75] Inventors: Gerhard Merten; Martin Hermann, both of Lunen, Fed. Rep. of Germany

[73] Assignee: Westfalia Becorit Industrietechnik GmbH, Fed. Rep. of Germany

[21] Appl. No.: 769,551

[22] Filed: Oct. 1, 1991

[30] Foreign Application Priority Data

Apr. 10, 1990 [DE] Fed. Rep. of Germany ..... 4031211

[51] Int. Cl.[5] ..... E21C 27/32

[52] U.S. Cl. ..... 299/34; 299/44; 198/520

[58] Field of Search ..... 198/517, 520, 719, 748; 299/34, 43, 44

[56] References Cited

U.S. PATENT DOCUMENTS 4,063,781 12/1977 Georg et al. ..... 299/43

4,332,421 6/1982 Merten et al. ..... 299/43

4,583,785 4/1986 Breuer et al. ..... 299/43

*Primary Examiner*—Joseph E. Valenza

*Attorney, Agent, or Firm*—Samuels, Gauthier & Stevens

[57] ABSTRACT

A retraction mechanism for drawing a plough drive chain into a chain channel of a coal plough guide built onto the side of a scraper chain conveyor comprises a retraction slide which can be drawn through the chain channel and guided. The plough chain is connected to the slide which, via a chain section and a chain claw can be connected to an external traction drive, preferably to the scraper chain assembly of the scraper chain conveyor, so that the mechanism can draw the plough drive chain through the chain channel. The traction chain incorporates an overload clutch which limits the traction force. The clutch has two complementary parts one of which has a detent ball pressed by a prestressed spring into a detent recess of the other clutch part, so that the clutch is closed. A releasable lock or fixing device secures the detent ball in its released position.

15 Claims, 3 Drawing Sheets

MECHANISMS FOR DRAWING A CHAIN INTO OR THROUGH A CHANNEL OF A CHAIN GUIDE

FIELD OF THE INVENTION

The present invention relates to a mechanism for drawing a chain into or through a chain channel of a chain guide, particularly a coal plough guide built onto a scraper chain conveyor.

BACKGROUND TO THE INVENTION

In known mining equipment for the underground mining of coal or other mineral products, the working face side of a scraper chain conveyor is often fitted with lateral chain guides in which is guided a driven chain with which a mining machine, e.g. a plough, is moved along the scraper chain conveyor. In the usual coal plough installations the chain guide at the same time forms a guide for the plough. In general, the plough guide has two such chain channels situated one above the other, of which one chain channel, usually the lower one, has an aperture in the form of a slot, through which the plough passes. The plough is then affixed to the center of the plough chain by means of guide blocks.

In practice, the plough chain is drawn or retracted into the lower channel of the plough guide from time to time by means of a suitable mechanism e.g. for assembly to the plough. A known mechanism has a retraction slide which can be inserted from the outside through the slot of the plough guide into the lower channel of the latter and to which the chain to be drawn through the channel is affixed by its end. In this system, the retraction slide is connected, outside the plough guide, to a traction member, e.g. a traction chain, provided at its other end with a so-called chain claw, i.e. a coupling piece, by the aid of which the mechanism can be connected to a scraper chain assembly of the scraper chain conveyor, so that with the aid of the driven scraper chain assembly the retraction slide and thus the plough chain coupled to it can be drawn through the chain channel of the plough guide. The mechanism thus serves as an aid to the assembly by drawing the plough chain into the particular chain channel to which access from the outside is difficult, if not impossible, when the plough guide is attached.

If one or more chain pieces are used for the traction member they usually consist of heavy oval-link chain sections, and overloads may develop particularly on the chain claw and the retraction slide, when blockages occur during the displacement of the drive chain, e.g. when the retraction slide tilts or jams. This may cause serious damage to the constructional parts, as the mechanism is in a drive connection with the scraper chain assembly of the scraper chain conveyor and the latter cannot be immediately brought to a stop. Breakages of the mechanism, moreover, present a serious danger to the coal face workers.

An object of the invention is to provide an improved mechanism or gear of the aforementioned kind in which drawing of the drive chain is not accompanied by any serious risk of danger to personnel or damage to equipment.

SUMMARY OF THE INVENTION

According to the invention there is provided a mechanism for drawing a chain into or through a chain channel of a chain guide, particularly a coal plough guide built onto a scraper chain conveyor; said mechanism comprising a retraction slide for passing through an opening in the channel which extends longitudinally of the channel and to which the chain can be connected at one end, a traction member which is affixed to the retraction slide, means for connecting the traction member to a traction drive outside the channel and an overload protection clutch incorporated in the traction member, said clutch comprising one part with a detent element pre-loaded with spring means and another part with a recess for receiving the said detent device.

The overload clutch incorporated in the traction member which transmits the tractive forces between the retraction slide and the connection means e.g. a chain claw or the like, automatically interrupts the force transmission in the event of an overload, so that even if heavy oval-link chain sections are used no major risk of accident is present and also no serious damage can occur. The overload clutch can limit the maximum chain retraction force to an unproblematical magnitude of about 70–80 kN. The clutch can be designed in such a way that after release and after the removal of any fault it can be re-closed without difficulty.

The detent element preferably consists of a simple detent ball and the detent recess is then a corresponding spherical calotte or the like. Alternatively, however, other detent elements can be used, such as detent rods with corresponding detent recesses. In a preferred version the one part of the overload clutch consists of a receiver piece which is provided with the spring-loaded detent device and with an insertion aperture for receiving the other clutch part having the detent recess. The detent element is then capable of being displaced or pressed back, in opposition to the restoring force of its spring, from its detent position, in which it projects transversally into the insertion aperture and engages the detent recess, into a release position in which it is disengaged from the detent recess of the other clutch part. The receiver piece can thus form a clutch lock into which the clutch part having the detent recess can be inserted in order to close the overload clutch.

According to a further constructional characteristic of the invention, a releasable lock is provided which holds the element device in its released position. This offers the special advantage that when the detent element is held in the released position, the overload clutch can be closed by hand without any particular effort and without having to overcome the high biasing force of the prestressed spring means. When the clutch part occupies the coupled position the lock can be released manually, so that the detent element, by spring force, engages the detent recess of the clutch part concerned. The lock may consist, first and foremost, of any mechanical type, such as the wedges, levers or toothed types. Preferably a further slide is provided. The further slide is situated outside the guide for engaging on an upper region of the guide. The further slide can be incorporated in the traction member between the clutch and the first mentioned slide.

For the overload clutch according to the invention special advantages are offered by the use of overload devices known per se, such as are customary for torque clutches with torque limiting systems (DE-OS 34 02 880, DE-GM 88 03 480.1). These overload devices comprise a housing containing a spring-loaded stepped piston or pressure bolt carrying a detent ball resting in a ball socket and pressed by a spring device into a ball recess on the other clutch part. The spring biasing system, adjustable by a setting nut, determines the overload torque with which the detent ball is pressed out of the other clutch part, thus opening the clutch. The overload device can be fitted with the aforementioned lock which secures the detent ball in the released position. This lock can consist of wedge ring segments which embrace the pressure bolt and which at the back rest via tapered surfaces against an annular pressure disc loaded by the spring device and which rest by further tapered surfaces against a suitably tapered shoulder surface of the pressure bolt. When the clutch responds the pressure bolt is held in the released position by the detent ball through a wedging action. In this position, the pressure bolt extends by its rear end from the receiving housing. The locking action can then be nullified by applying pressure or a blow to the protruding end.

When the overload device known for torque clutches is used for limiting the tractive force in the mechanism according to the invention this enables the latter to be constructed on particularly simple lines and also renders it particularly easy to handle. A component already available on the market can be used for its overload clutch and this latter can be rapidly and easily re-closed after it has responded. In the overload clutch of the retraction mechanism according to the invention the known overload device is mounted on the receiver piece of the clutch itself. For this purpose the receiver piece is preferably provided with a boring which takes a direction transversal to its insertion aperture and which is engaged by the housing belonging to the overload device.

The traction member of the retraction gear preferably consists of a chain section, particularly a round or oval-link chain section. The overload clutch is then advantageously flexibly suspended into the traction chain of the retraction mechanism.

In matters of detail the system can with advantage be so arranged that the receiver piece of the overload clutch has a compartment or recess or the like which continues the whole way through the receiver piece in the chain traction direction and which forms the insertion aperture and which is engaged from one side by a chain connector permanently joined to the receiver piece, preferably by welding, and into which the other clutch part having the detent recess can be inserted from the other side. The other clutch part may consist of a simple chain link end piece of the traction chain constructed more of less on the lines of a half-loop, of which the parallel sides, interconnected by the band in the chain link, are flattened and preferably connected by a ridigifying crosspiece having the detent recess on one or both sides. The insertion aperture of the receiver piece is then given the approximate form of a slot to adapt it to the flattened sides. The chain connector and the chain link piece are similar in shape and each advantageously suspended into a chain joint with the traction chain of the retraction mechanism.

The mechanism according to the invention is also preferably designed in such a manner that one part of the overload clutch is connected to chain claw or the like, which can be connected to the scraper chain assembly of the scraper chain conveyor having the chain guide or coal plough guide, while the other part of the overload clutch is connected to the retraction slide via a traction chain section of the traction member.

The mechanism in accordance with the invention can be employed with particular advantage for drawing a coal plough drive chain into the chain channel of a plough guide built onto the scraper chain conveyor on the coal face side with the driven scraper chain assembly of the scraper chain conveyor serving as the traction drive. The mechanism can also be used, however, for drawing a chain into a chain guide which is situated on the stowage side of the scraper chain conveyor and which here again the chain guide can serve as the guide for a coal plough or other mining machine.

The traction drive may also consist of a winch cable or similar device in place of the scraper chain assembly.

The invention may be understood more readily and various other aspects and features of the invention may become apparent from consideration of the following description.

BRIEF DESCRIPTION OF DRAWINGS

An embodiment of the invention will now be described, by way of example only, with reference to the accompanying drawings, wherein.

DESCRIPTION OF PREFERRED EMBODIMENT

Figure 1:
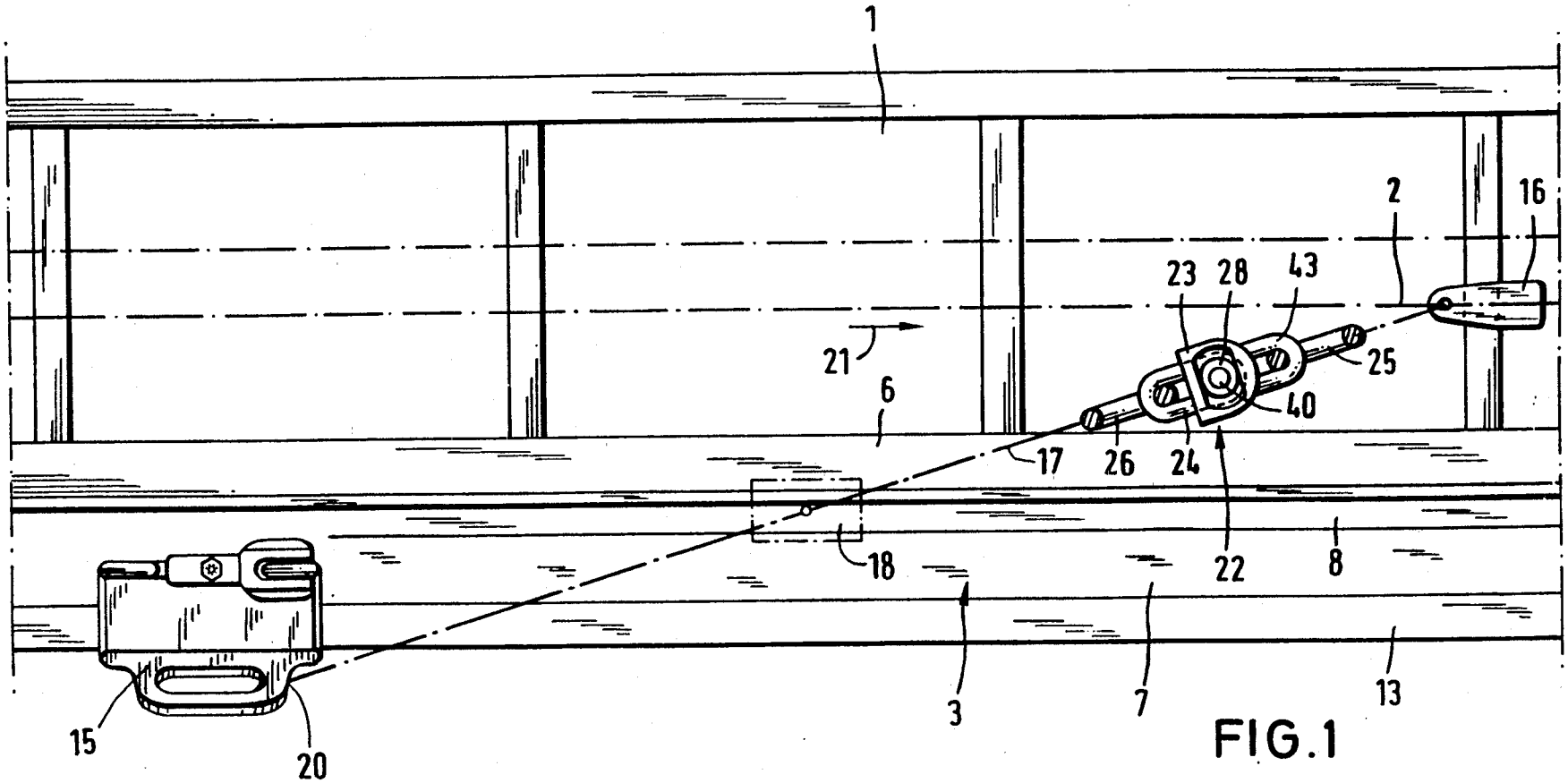
FIG. 1 is a schematic plan view of a portion of a scraper chain conveyor with a built-on coal plough guide together with a mechanism constructed in accordance with the invention shown in its operating position.
Figure 2:
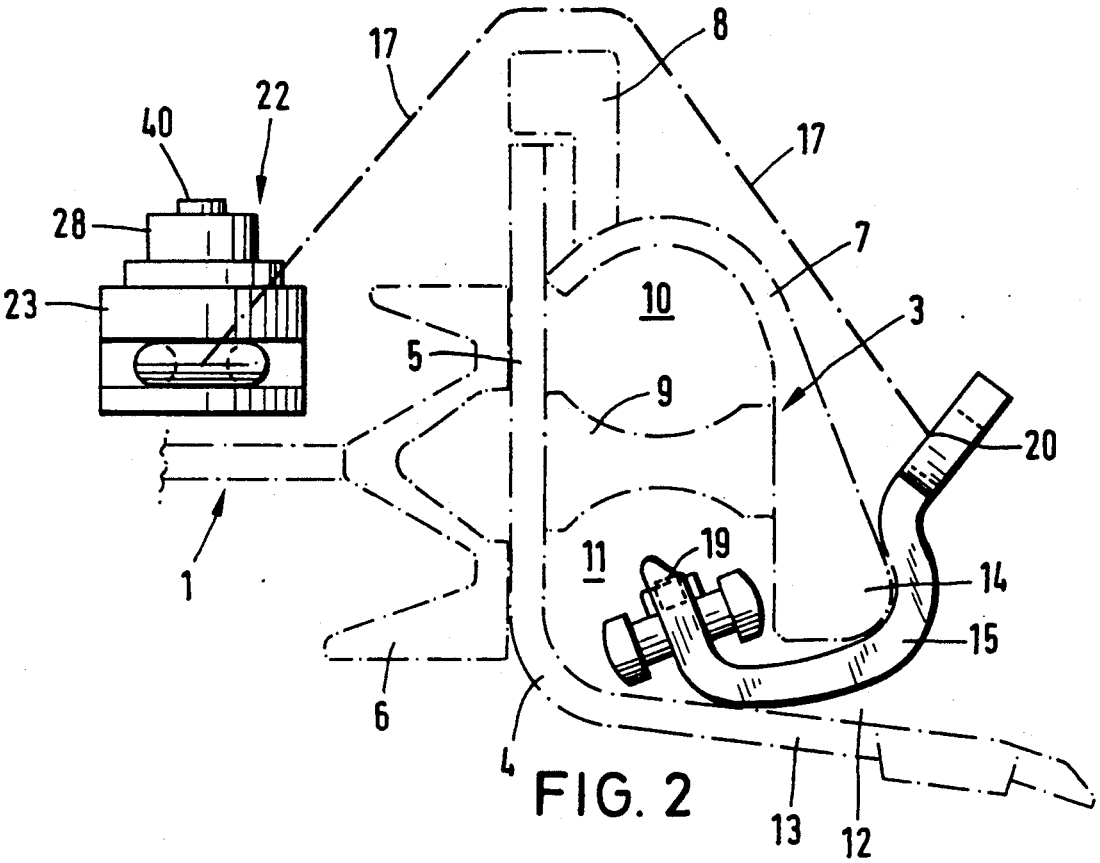
FIG. 2 is a schematic cross-sectional end view of the arrangement shown in FIG. 1 but only showing the zone of the conveyor channel section which is nearest to the coal face.

FIGS. 1 and 2 depict a conveyor channel section or pan 1 of a scraper chain conveyor. In this case the conveyor takes the form of an in-board conveyor with a scraper-chain assembly with one or more chains 2 fitted to the scrapers and running in the central zone of the conveyor channel sections 1. Scraper chain conveyors of this kind are commonly used as longwall mine workings. A coal plough guide 3 known as per se is built onto the coal face side of the scraper chain conveyor. This guide 3 mainly consists of angle plates 4 connected by their upwardly extending sides 5 to the coal face side walls 6 of the conveyor channel sections 1, covering hoods 7 each provided with an upwardly extending guide bar 8 and collectively forming an upper guide for the coal plough, and sliding spacers 9 positioned between an upper chain channel 10 and a lower chain chain 11. A drive chain, (not shown in the drawings) is guided in the channels 10, 11. The traction run of the drive chain, which is connected to the coal plough (not shown in the drawing) and guided on the plough guide 3, extends along the lower chain channel 11. The plough guide 3 is provided, in its lower zone, with a slot-like entry aperture 12 which is delimited at the bottom by lower sides 8 of the angle plates 4, which rests on the floor, and by a guide beam 14 terminating a certain distance above it and belonging to the plough guide. The covering hoods 7 can be moved over on pivot joints towards the coal face in the known manner, as result of which the upper chain channel 10 becomes accessible from the outside. In accordance with the invention, a mechanism serves draw the coal plough chain into or through the lower chain channel 11 of the plough guide 3.

The basic structure of the mechanism is likewise known. The mechanism consists of a retraction slide 15 and a chain claw 16 which are connected together via a flexible traction member 17.

The traction member 17 can be formed by a length of chain e.g. an oval-link chain section. The traction member 17 preferably also incorporates a rail slide 18 which on the displacement of the drive chain is guided on the upper guide bar 8 of the plough guide 3.

For effecting the drawing of the drive chain into the chain channel 11 the approximately U-shaped or hooked retraction slide 15, as shown in FIG. 2, is introduced into the lower chain channel 11 and connected at 19 to the end of the drive chain. The traction member 17 is connected at 20, to the retraction slide 15 outside the plough guide 3. During the drawing of the plough drive chain the retraction slide 15 is guided on the parts 13 and 14 of the plough guide as shown in FIG. 2. The scraper-chain assembly 2 of the scraper chain conveyor serves as the traction drive for the member 7. For this purpose, the traction member 17 of the mechanism is connected by a chain claw 6 to the scrape-chain assembly 2, so that on movement in the direction shown by the arrow 21 (FIG. 1) the mechanism causes the plough drive chain to be drawn from the end into the channel 11.

In FIG. 2 the course taken by the traction member 17 is only shown schematically and the rail slide 18 is omitted for the sake of clarity. That end zone of the traction member 17 which is situated above the conveyor channel 1 incorporates an overload clutch 22 which limits the tractive force in the traction member 17 of the mechanism and at a certain preselected maximum tractive force interrupts the drive connection between the mechanism or more particularly its retraction slide 15 and the driven scraper chain assembly 2 of the scraper chain conveyor.

Figure 5:
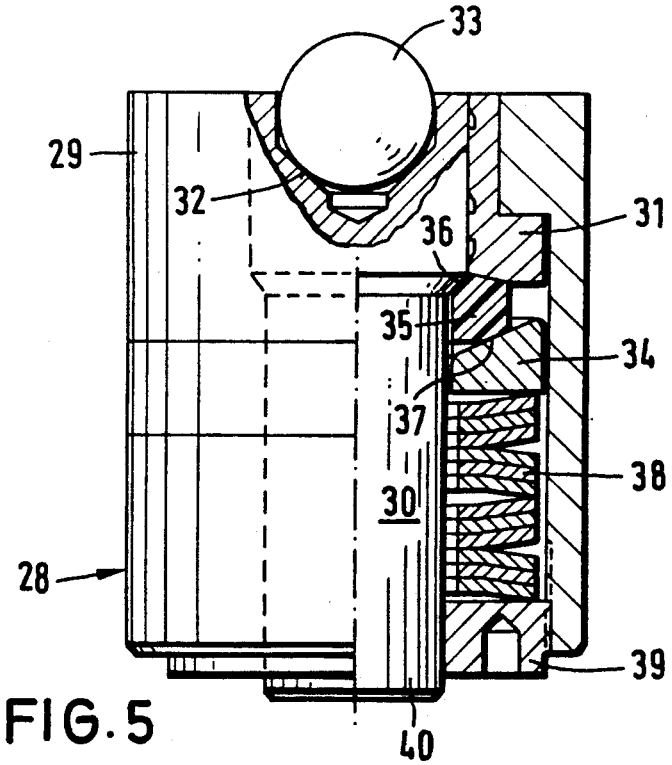
FIG. 5 is a part-sectional end view of a component of the clutch shown in FIGS. 3 and 4.
Figure 3:
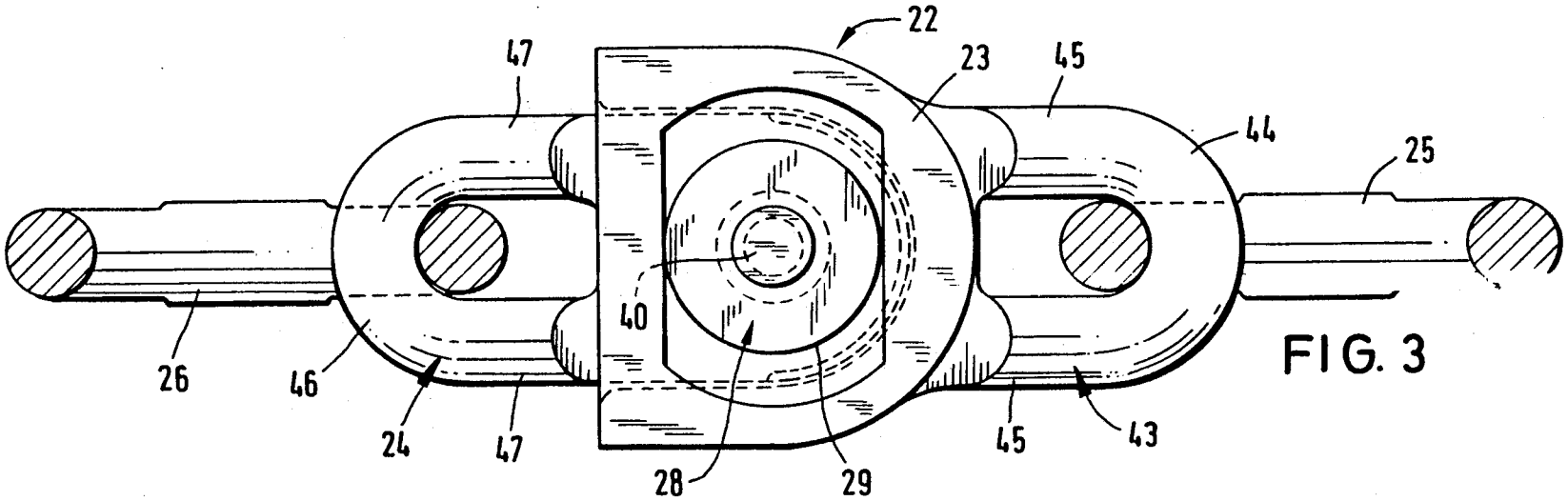
FIG. 3 is a front elevation of an overload clutch used with the mechanism illustrated in FIGS. 1 and 2, the view being taken on a somewhat larger scale.
Figure 4:
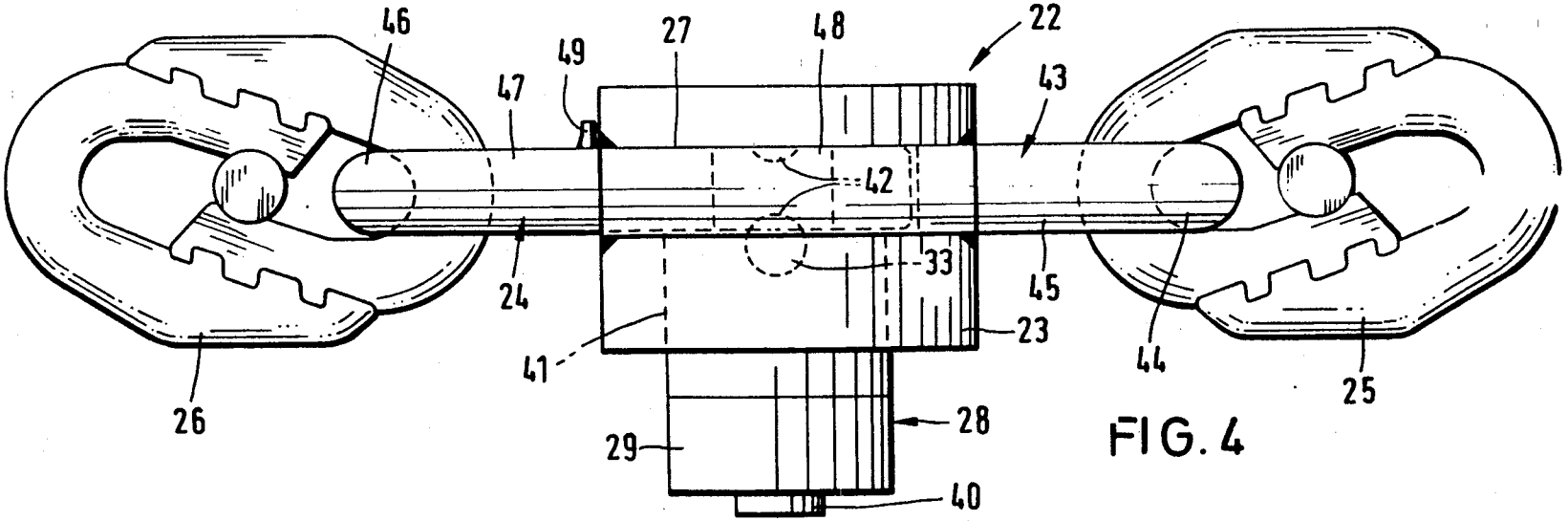
FIG. 4 is a schematic plan view of the overload clutch shown in FIG. 3.

A preferred embodiment of the overload clutch 22 is shown in particular in FIGS. 3 to 5. The overload clutch 22 consists of the two complementary clutch parts 23 and 24, suspended via chain locks 25 and 26 respectively into the traction member 17. The clutch part 23 in this case consists of a receiver piece of the nature of a coupling lock having an insertion aperture 27 which coincides with the axis of the traction member 17 and into which the other clutch part 24 can be inserted in order to close the overload clutch. On one side of the receiver piece 23 is affixed an overload device 28, preferably of the kind known in torque clutches, such as may be seen from DE-OS 34 02 860. The known overload device 28 of this kind is illustrated in FIG. 5. The device 28 is of cartridge-like configuration with a cylindrical housing 29, containing a stepped pressure bolt or piston 30. The part of the piston 30 of largest diameter is guided in a bushing 31, and has a socket 32 provided with a dentent bail 33. The part of the piston 30 with the smallest diameter is surrounded by a pressure ring 34 and wedge segments 35, which on one side rest against an inclined shoulder 36 of the pressure piston 30 and on the other side rest by their rear wedge surfaces against an inclined surface 37 of the pressure ring 34. The ring 34 is subjected to the action of prestressed spring means 38 consisting, for example, of a stack of plate springs resting against an adjusting nut 39 in screw-threaded engagement with the housing 29 by means of which the spring biasing action can be adjusted and set. The parts 34 and 35 form a lock by which the pressure piston 30 and thus the detent ball 25 are secured in the release position. In the release position, the rear end 40 of the piston 30 projects outwardly from the housing 29. By the application of pressure or a blow to the end 40 of the piston 30 the wedge action of the lock can be nullified and the detent ball 33 is thus caaused to assume the detent position.

As may be seen above all from FIG. 4, the overload device 28 is inserted with its housing 29 into a boring 41 in the receiver piece 23 and fixed so that the detent ball 33, in the detent position, projects into an aperture 27 to engage with a calotte-shaped detent recess 42 of the clutch part 24. The detent ball 33 is pressed under the action of the spring means 38 into the recess 42 and the overload clutch is thus closed.

The receiver piece 23 has a compartment or recess which continues the whole way through in the axial direction and in the direction of the traction member 7 and which defines the insertion aperture 27. One end of the aperture 27 embraces a chain connector 43 permanently connected by welding to the receiver piece 23. The receiver piece 23 preferably consists of two halves welded together. The chain connector 43 is flexibly suspended by its chain link bend 44 into the chain lock 25. The ends of the two parallel sides 45 of the connector 43 preferably engage with the continuous recess of the receiver piece 23 and are permanently connected in this position with the receiver piece 23 as a unit as a result of which the recess is closed in its end zone.

The clutch part 24 consists of a chain connector suspended by its circular bend 46 into the chain lock 26, while its two parallel sides 47, are adapted to the cross section of the approximately slot-shaped insertion aperture 27 and are flattened to a rectangular shape and welded together in the zone of their free ends by a rigidifying crosspiece 48 provided with the calotte-shaped detent recess 42. There are preferably provided one detent recess 42 on each of two mutually opposite side surfaces of the crosspiece 48, so that the latter, in either of its two positions, can be introduced into the insertion aperture 27 and connected. The depth to which the part 24 is inserted before the overload clutch closes can be limited by a stop 49.

The drawing shows the overload clutch 22 in the closed state, in which the detent ball 33 has engaged the detent recess 42 of the clutch part 24 introduced into the insertion aperture 27. When the tractive force in the traction member 17 exceeds the maximum selected by the setting of the spring means 38 the detent ball 33 is pressed back with the pressure piston 30, in opposition to the restoring force of the spring means 38, into the housing 29 of the element 28, so that the overload clutch 22 is opened. In this process the pressure piston 30 emerges from the housing 29 by its rear end 40. When the overload clutch re-closes, therefore, the clutch part 24 can be freely introduced into the insertion aperture 27 of the receiver piece 23. The locking action is then nullified by a blow on the end 40 of the piston, so that the detent ball 33 is pressed back into the detent recess 42 by the spring means 38, to re-close the clutch.

We claim:

1. A mechanism for drawing a chain into or through a chain channel guide, particularly a coal plough guide built onto a scraper chain conveyor; said mechanism comprising a retraction slide for passing through an opening in the channel which extends longitudinally of the channel and to which the chain can be connected at one end, a traction member which is affixed to the retraction slide, connection means for connecting the traction member to a traction drive outside the channel and an overload protection clutch incorporated in the traction member, said clutch comprising one part provided with a detent element preloaded with spring means and another part provided with a recess for receiving the said detent element.

2. A mechanism according to claim 1, wherein said one part of the overload clutch consists of a receiver piece equipped with the detent element and provided with an insertion aperture for containing the detent recess of the other part, the detent element being displaceable in opposition to the restoring force of the spring means from a detent position, in which it projects into the insertion aperture and engages the detent recess into a release position in which it is disengaged from the detent recess.

3. A mechanism according to claim 2, and further comprising locking means for securing the detent element in its release position.

4. A mechanism according to claim 2, wherein the detent element and its spring means are located in a separate housing mounted on the one clutch part.

5. A mechanism according to claim 4, wherein the receiver piece has a boring in which the housing is mounted and affixed to the receiver piece.

6. A mechanism according to claim 4 wherein the detent element rests against a piston guided in the housing and biased by the spring means.

7. A mechanism according to claim 6 wherein the piston extends from one end of housing when the detent element is released from the recess and locking means secures the detent element in the release position.

8. A mechanism according to claim 7 wherein the locking means consists of wedge elements positioned in the housing to surround the piston and which can be adjusted towards the piston by spring means.

9. A mechanism according to claim 1 wherein the detent element consists of a detent ball and the detent recess consists of a spherical calotte.

10. A mechanism according to claim 1 wherein the traction member consists of a traction chain into which the overload clutch is flexibly suspended.

11. A mechanism according to claim 10, wherein the one part of the overload clutch is provided with a recess which is engaged from one side by a chain connector connected rigidly with the one part and into which the other clutch part having the detent recess can be inserted from the other side.

12. A mechanism according to claim 11 wherein the other clutch part having the detent recess consists of a chain link end piece with parallel sides interconnected by a chain link bend, the sides being flattened and interconnected by a crosspiece having the detent recess and the recess of the one clutch part is slot-shaped in order to adapt it to the flattened sides of the other clutch part.

13. A mechanism in according to claim 12 wherein the chain connector and the chain-link end piece are suspended in chain locks of a chain forming traction member.

14. A mechanism according to claim 1 wherein the one clutch part of the overload clutch is connected to a chain claw which is connectable to a scraper chain assembly of the scraper chain conveyor having the chain guide, while the other clutch part is connected via the traction member to the retraction slide.

15. A mechanism according to claim 1 and further comprising a further slide external to the channel for engaging on an upper region of the guide, the further slide being incorporated in the traction member between the clutch and the first mentioned slide.

* * * * *